United States Patent [19]

Wempe et al.

[11] 4,220,097

[45] Sep. 2, 1980

[54] CONTINUOUS CRADLE PAD AND SKID FOR RAILWAY CARS

[75] Inventors: Richard J. Wempe; Paul J. Dumser, both of St. Charles, Mo.

[73] Assignee: ACF Industries, Incorporated, New York, N.Y.

[21] Appl. No.: 905,499

[22] Filed: May 12, 1978

[51] Int. Cl.[3] ..... B61D 5/00

[52] U.S. Cl. ..... 105/360; 105/439; 137/377; 137/382; 251/144

[58] Field of Search ..... 105/358, 360, 450, 361, 105/362, 439; 137/377, 382; 308/137; 251/144

[56] References Cited

U.S. PATENT DOCUMENTS

| | | | |
|---|---|---|---|
| 1,988,308 | 1/1935 | Flomsbee | 105/362 |
| 3,308,769 | 3/1967 | Halcomb et al. | 105/362 |
| 3,326,141 | 6/1967 | Graves | 105/358 |
| 3,766,862 | 10/1973 | Heap et al. | 105/360 |

*Primary Examiner*—Charles E. Frankfort

*Attorney, Agent, or Firm*—Henry W. Cummings

[57] ABSTRACT

In accordance with the present invention, a railway tank car is provided with a tank car skid arrangement including a continuous tank cradle pad extending the full distance between the stub sills located at opposite ends of the car. The cradle pad is curved to follow the tank bottom contour. A reinforcing plate is rigidly attached to the cradle pad extending transversely and longitudinally outwardly on either side of at least one tank car bottom fitting (lading valve and/or sump) depending from the tank bottom. The reinforcing plate is preferably also curved to follow the contour of the cradle pad and the tank bottom. A tank car skid extending longitudinally and transversely of the bottom fitting is rigidly attached to the reinforcing plate. The skid includes opposite end portions which are welded to the tank and which extend downwardly and inwardly toward a center section which contains the bottom fitting. The skid preferably extends longitudinally of the tank at least three inches on each side of the projection for each one inch that the bottom fitting extends below the outer surface of the tank bottom.

18 Claims, 10 Drawing Figures

CONTINUOUS CRADLE PAD AND SKID FOR RAILWAY CARS

BACKGROUND OF THE INVENTION

This invention relates to skids to protect bottom fittings of railway tank cars.

Previously bottom fittings of railway tank cars, including particularly the lading outlet valve and siphon pipe sump, have been protected by a through sill extending between trucks at opposite ends of the tank car. The bottom fittings have been located within transversely spaced legs or webs of the through sill. This method of bottom fitting protection is undesirable because the through sill adds considerable weight to the car. See, for example, U.S. Pat. Nos. 3,766,862 (1973) and 928,924 (1909).

To reduce the weight caused by the through sill, stub sill tank cars have been utilized. See, for example, U.S. Pat. No. 3,308,769 (1967).

However, recent AAR and DOT Regulations for railway tank cars require that depending projections extending below the outer surface of the tank in excess of one (1) inch by protected by a skid having three (3) longitudinal dimensions 3*a* (FIGS. 4 and 6) on each side of the projection for each one (1) dimension (a) extending downwardly from the tank bottom.

In application Ser. No. 860,987 filed Dec. 15, 1977, now U.S. Pat. No. 4,184,663, a combination tank car skid and lading valve seat is disclosed in which the outer ends of the skid abut, but are not welded to, the tank bottom, and in which opposite end portions are inclined inwardly and downwardly toward a center section containing the bottom outlet valve. However, stress calculations based on the weight of the tank, the weight of the lading, and the horizonal train action and impact loads indicate that a pair of reinforcing plates are required between the skid and the tank. One large reinforcing plate is needed to extend a substantial distance between the trucks and the other plate located in the mid-portion of the tank, near the bottom fittings. If the large reinforcing plate terminates inboard of the tank car stub sill, the unreinforced tank portion between the inner end of the stub sill and the outer end of the skid is subject to fatigue failure, due to the cycling train action and rail yard impact loads.

THE DRAWINGS

DESCRIPTION OF PREFERRED EMBODIMENTS

Figure 1:
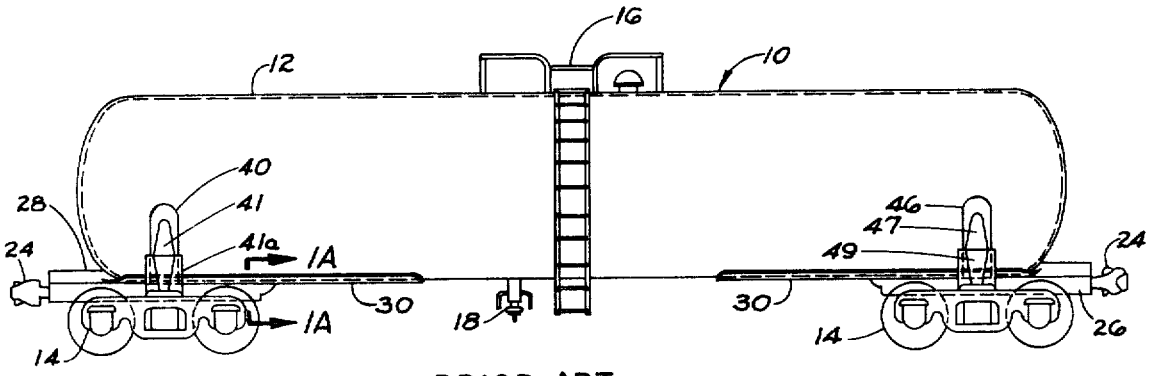
PRIOR ART Fig. 1
FIG. 1 is a side elevation view illustrating a railway tank car adapted to receive the skid arrangement of the present invention.
Figure 1A:
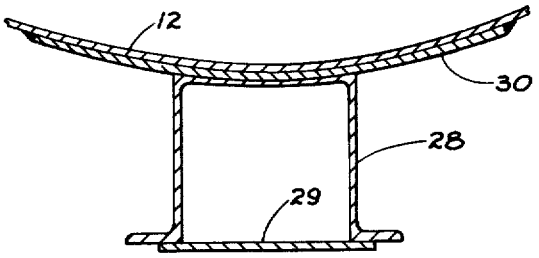
PRIOR ART Fig 1A
FIG. 1A is a vertical view looking in the direction of the arrows along the line 1A—1A in FIG. 1.

As shown in FIG. 1 a railway tank car indicated generally at 10 includes a tank body 12 of conventional construction. Trucks 14 support the tank car at opposite ends. A top manway 16 includes a top operator for a lading valve indicated generally at 18 in the tank bottom. Tank car end structure indicated generally at 20 includes a coupler 24, and a draft gear 26 located within a stub sill 28 having a closure plate 29. A cradle pad 30 is welded to the stub sill 28 and to the tank bottom 12 along its outer perifery. See FIG. 1A. The details of the cradle pad end structure are described in U.S. Pat. No. 3,308,769, incorporated into the present application by this reference.

Figure 2:
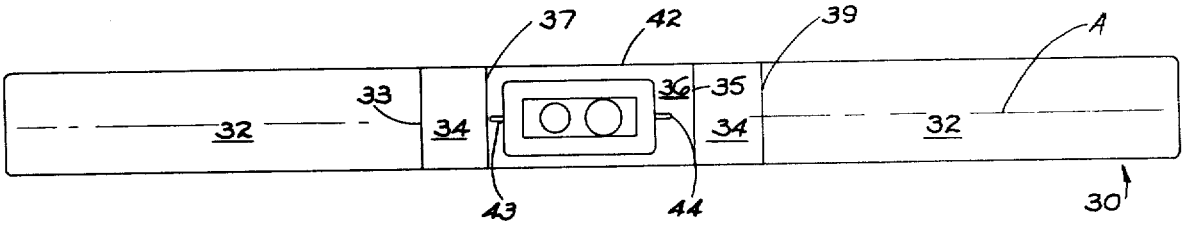
FIG. 2 is a bottom view of one embodiment of the skid arrangement of the present invention.

As shown in FIG. 2, the cradle pad 30 extends the entire length between the trucks 14 along the longitudinal axis A. The cradle pad is conveniently made in sections of plates indicated at 32, 34 and 36 welded together along weld lines 33, 35, 37 and 39 which do not penetrate to the tank body 12 as shown in FIG. 2. The cradle pad is welded at its outer perifery to the tank bottom along its entire longitudinal length.

A cradle plate 40 is supported on sill 28 (FIG. 1). A side brace plate 41 on each side of tank body 12 is secured along its upper edge to body 12 and along its lower edge to bolster end cover plate 41*a*.

Figure 5:
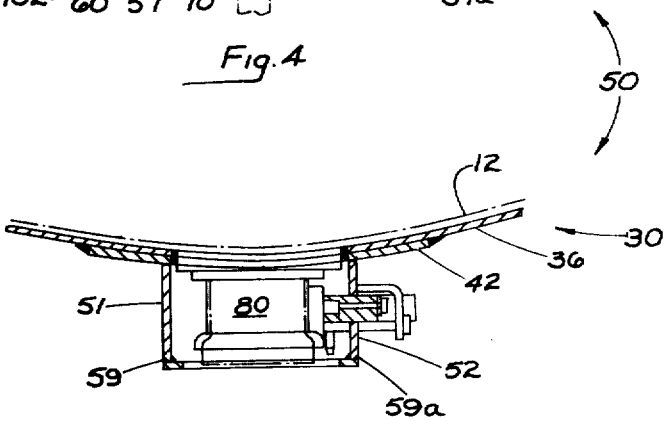
FIG. 5 is a transverse sectional view illustrating the skid arrangement of the present invention.

A reinforcing plate 42 is welded to cradle pad 30. Slots 43 and 44 in reinforcing plate 42 receive welds 43*a* and 45 to the cradle pad. FIG. 5 shows that the cradle pad 30 and the reinforcing plate 42 are both curved, having the same curvature as the tank bottom 12.

Figure 3:
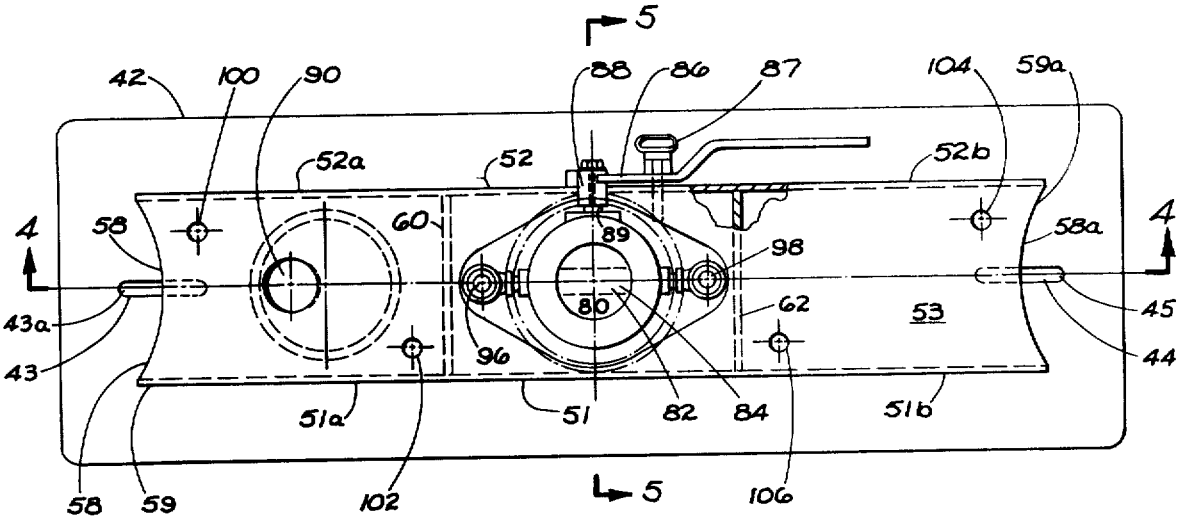
FIG. 3 is an enlarged bottom view of the skid arrangement shown in FIG. 2.

Rigidly attached to the reinforcing plate 42 is a skid indicated generally at 50. Skid 50 includes longitudinally extending reinforcing plates 51 and 52 tapered at their ends as shown at 51*a* and 51*b*, and 52*a* and 52*b* (FIG. 3). Skid 50 further includes a large formed plate 53 including a pair of inclined bottom portions 54 and 56 welded to the reinforcing plate 42 at 58 and 58*a*, and to plates 51 and 52 as shown at 59 and 59*a*.

The plate 53 includes a center opening 55. Inner portions 57 and 57*a* are welded to transversely extending reinforcing plates 60 and 62. The upper ends of plates 60 and 62 are curved and are welded to reinforcing plate 42 as indicated at 61 and 63.

A lading valve 70 and a siphon type sump 72 are shown located within the skid 50. Outlet valve 70 includes a valve flange 74. Valve flange 74 and sump 72 are welded to the tank bottom and to cradle pad 30. Reinforcing plate 42 includes openings 47 and 48 through which the lading valve 70 and sump 72 project.

As an example, a ball valve indicated at 80 will be illustrated as a suitable lading valve. Ball valve 80 includes a ball 82 having a lading opening or passageway 84. Ball 80 is rotatable by means of a handle 86 attached to a socket 88 extending from shaft 89 between a closed position in which opening 84 is in the horizontal position as shown in FIG. 3 and an open position wherein opening 84 is in the vertical position. A bracekt 87 may be utilized to hold the handle 86 is closed position in transit. Note in FIG. 4 that handle 86 is above the bottom of skid 52.

The construction and operation of ball valves is conventional and it is not believed that an extended discussion of the ball valve construction and operation is required. Furthermore, the present skid arrangement is not be be construed as limited to a ball valve for loading and unloading the lading. Any suitable lading valve may be used.

Figure 4:
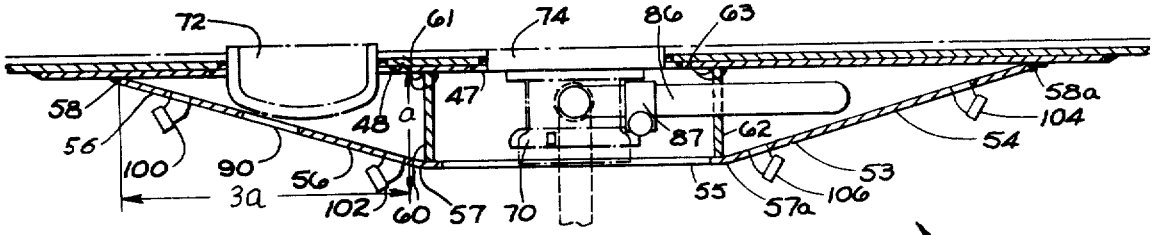
FIG. 4 is a longitudinal sectional view looking in the direction of the arrows along the line 4—4 in FIG. 3 illustrating the skid arrangement of the present invention.

An optical feature includes an inspection opening 90 illustrated in FIGS. 3 and 4.

Ball valve assembly 80 includes a steam inlet 96 and a steam outlet 98 which may be utilized in conjunction with ladings which solidify in transit or with viscous ladings. Steam is circulated through these connections to prevent any lading from congealing on the ball valve during unloading. Furthermore, additional steam may be circulated through an inlet indicated at 100 and an outlet indicated at 102 in skid wall 56. A similar inlet 104 and an optional outlet 106 may be supplied through the opposite skid wall 54. With this arrangement the skid walls take the place of steam coils often used in tank cars.

The skid portion 50 protects the lading outlet 70 and the siphon sump 72 from impacts which normally might shear one or both of these members off in the event the tank becomes disconnected from the truck 14. In the absence of such a skid, the impact could cause escape of the lading and danger to persons or property nearby. Thus the added weight occasioned by the skid arrangement of the present invention is justified.

It is thus seen that the present invention avoids the fatigue problem which normally would occur if cradle pads were used only at opposite ends of the car, leaving a portion of the tank bottom unsupported. It will be apparent that for reasons of safety it is more important to include a cradle pad extending the full distance between the trucks. Although this adds weight to the car, the danger to persons or property, if a fatigue failure would occur in the tank bottom and lading escape, is a greater risk and potential expense.

The embodiment shown in FIGS. 2–5 is constructed by fabrication.

Figure 7:
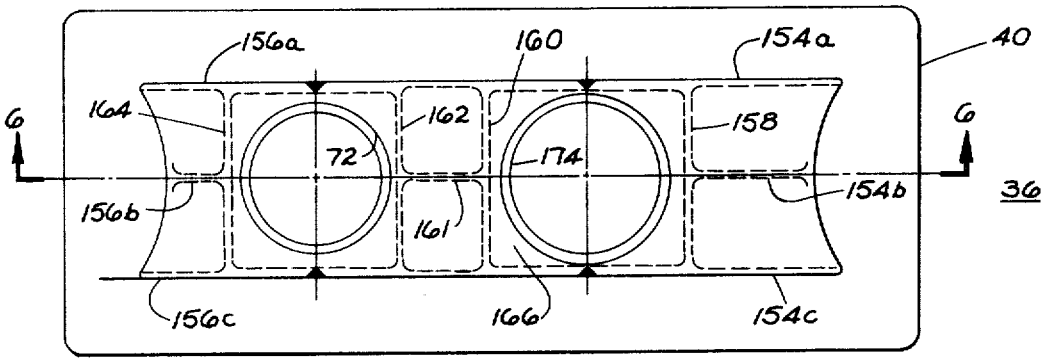
FIG. 7 is a bottom view illustrating an alternative cradle pad and skid arrangement of the present invention.
Figure 6:
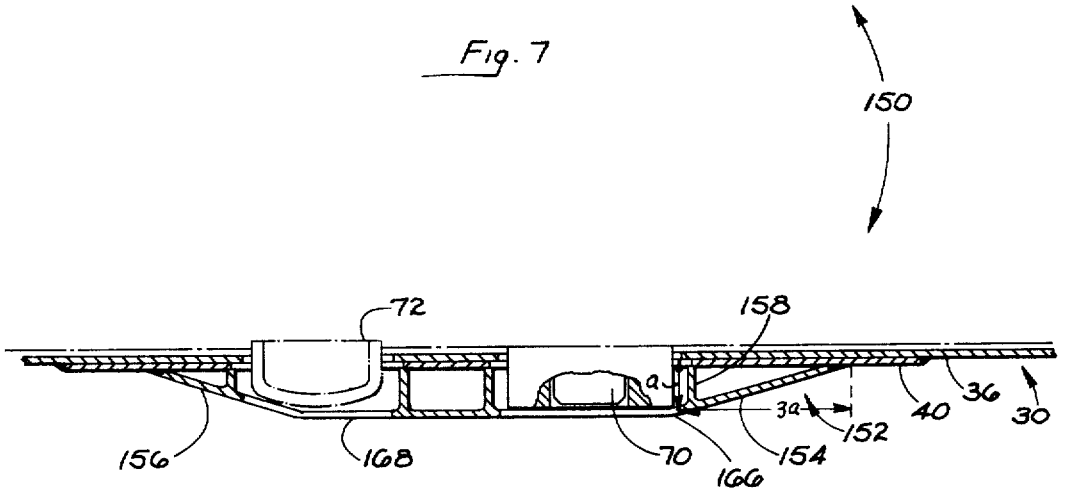
FIG. 6 is a longitudinal sectional view of another embodiment of a skid arrangement according to the present invention.

In another embodiment of the present invention shown in FIGS. 6 and 7, the skid portion is constructed of a casting. Skid portion 150 includes a casting 152, including inclined end portions 154 and 156, including longitudinal webs 154*a*, 154*b* and 154*c*; 156*a*, 156*b* and 156*c*. A series of transverse webs 158, 160, 162 and 164 are likewise provided. An inner longitudinal web 161 joins webs 160 and 162.

Casting 150 further includes an opening 166 to accommodate bottom outlet valve 70, such as a ball valve 80 having a valve flange 74, and a second opening 168 to accommodate siphon pipe sump 72. Opening 168 may be eliminated in applications where a siphon pipe sump is not provided in the tank bottom. Similarly, for tanks which are loaded and unloaded from the top, bottom opening 166 may be eliminated.

The number of transverse and longitudinal webs also may vary depending upon the number of depending bottom fittings, the thickness of the cast metal, and other known design criteria. It will be apparent, however, from FIGS. 6 and 7 that the skid portion of the skid arrangement of the present invention can be constructed solely or partially of a casting in addition to the fabrication technique illustrated in FIGS. 3–5.

Figure 8:
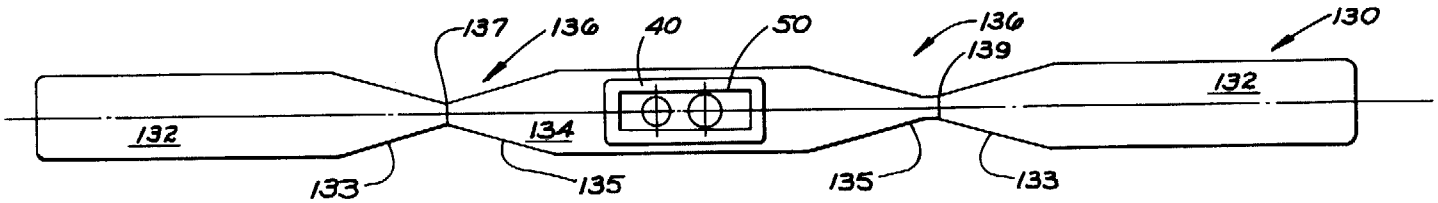
FIG. 8 is a bottom view illustrating an alternative cradle pad arrangement.

FIG. 8 illustrates a modified continuous cradle pad 130. Cradle pad 130 includes end portions 132 and a center portion 134 separated by transition portions 136 of reduced transverse extent. End portions 132 include converging inner ends 133. Center portion 134 includes converging outer end 135. Note that end portions 132 join center portion 134 along transverse weld lines 137 and 139. These transverse welds should not penetrate to tank body 12. The reduction of the transverse extent of the cradle pad in the transition portion 136 results in a reduction in weight of the cradle pad. All portions of the cradle pad 130 are curved to follow the contour of the tank bottom.

The steel for the cradle pad is purchased on a per-pound basis. Thus, a reduction in cost of steel for the cradle pad is achieved with the embodiment shown in FIG. 8.

Figure 9:
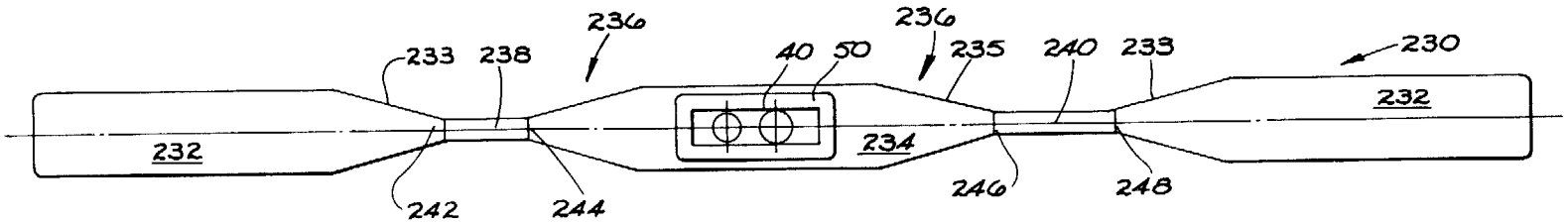
FIG. 9 is a bottom view illustrating still another cradle pad arrangement.

Another cradle pad is illustrated at 230 in FIG. 9. Cradle pad 230 includes spaced end portions 232 having diverging inner ends 233. A center portion 234 is similarly provided having diverging outer ends 235. Transition sections 236 are provided having diverging outer ends 237. Transition section 236 includes cradle pad spacers 238 and 240 located between end portions 232 and center portion 234, and welded to each one along weld lines 242, 244, 246 and 248 which also do not penetrate to the tank. All portions of the cradle pad 230 are curved to follow the contour of the tank bottom.

The use of spacers 238 and 240 is an alternative way of reducing the weight of the cradle pad. As mentioned above, reduction in the transverse extent of the cradle pad reduces the weight of the cradle pad and, hence, the cost of material for the cradle pad.

What is claimed is:

1. A railway tank car skid arrangement comprising: a continuous cradle pad located below a tank extending longitudinally of the car; said cradle pad extending below substantially the entire length of the tank between stub sills located at opposite ends of the car; said cradle pad being curved in the transverse direction to follow the tank bottom contour; a reinforcing portion integral with said cradle pad extending transversely on either side of the longitudinal center line of the tank and extending longitudinally outwardly from at least one tank car bottom fitting extending below the outer surface of the tank bottom; said reinforcing portion being curved in the transverse direction to follow the contour of the cradle pad; a tank car skid extending longitudinally and transversely of said bottom fitting rigidly attached to said reinforcing portion; said skid extending longitudinally of the tank at least three (3) inches on each side of the bottom fitting for each one (1) inch that said bottom fitting extends below the outer surface of the tank bottom; said skid being composed of opposite end portions rigidly connected to said reinforcing portion which end portions are inclined inwardly and downwardly toward each other, a skid center portion joining said skid end portions; and skid support means connected between said skid and said reinforcing portion to reinforce said skid.

2. A railway tank car skid arrangement according to claim 1 wherein said continuous cradle pad is welded to the tank along the outer perifery of said continuous cradle pad.

3. A railway tank car skid arrangement according to claim 1 wherein said skid support means includes a pair of transversely extending vertical webs extending between said reinforcing portion and said skid center portion.

4. A railway tank car skid arrangement according to claim 1 wherein said skid support means includes a pair of longitudinally extending reinforcing plates extending between said reinforcing portion and said skid center portion.

5. A railway tank car skid arrangement according to claim 1 wherein said skid center portion includes a first opening.

6. A railway tank car skid arrangement according to claim 5 wherein said skid support means includes a pair of transversely extending vertical webs, and a pair of longitudinally extending vertical webs and said first skid opening is located inboard of said transverse and longitudinal webs.

7. A railway tank car skid arrangement according to claim 5 wherein a lading valve is located within said first skid opening.

8. A railway tank car skid arrangement according to claim 5 wherein said skid comprises a fabrication.

9. A railway tank car skid arrangement according to claim 5 wherein said skid comprises a casting.

10. A railway tank car skid arrangement according to claim 5 wherein a second skid opening is located in said skid and wherein a sump is located above said second skid opening.

11. A railway tank car skid arrangement according to claim 5 wherein means are provided for circulating a heating fluid within said opposite end portions.

12. A railway tank car skid arrangement comprising: a continuous cradle pad located below a tank extending longitudinally of the car; said cradle pad extending below substantially the entire length of the tank between stub sills located at opposite ends of the car, said cradle pad being curved in the transverse direction to follow the tank bottom contour; a reinforcing plate rigidly attached to the cradle pad extending transversely on either side of the longitudinal center line of the tank and extending longitudinally outwardly from at least one tank car bottom fitting extending below the outer surface of the tank bottom; said reinforcing plate being curved in the transverse direction to follow the contour of the cradle pad; a tank car skid extending longitudinally and transversely of said bottom fitting rigidly attached to the reinforcing plate; said skid extending longitudinally of the tank at least three (3) inches on each side of the bottom fitting for each one (1) inch that said bottom fitting extends below the outer surface of the tank bottom; said skid being composed of opposite end portions rigidly connected to said reinforcing plate which end portions are inclined inwardly and downwardly toward each other; a skid center portion joining said skid end portions; and skid support means connected between said skid and said reinforcing plate to reinforce said skid.

13. A railway tank car skid arrangement according to claim 12 wherein said continuous cradle pad is welded to the tank along the outer perifery of said continuous cradle pad.

14. A railway tank car skid arrangement according to claim 12 wherein said skid support means includes a pair of transversely extending vertical webs extending between said reinforcing plate and said skid center portion.

15. A railway tank car skid arrangement according to claim 12 wherein said skid support means includes a pair of longitudinally extending reinforcing plates extending between said reinforcing plate and said skid center portion.

16. A railway tank car skid arrangement according to claim 12 wherein said cradle pad is constructed in separate pieces welded together.

17. A railway tank car skid arrangement according to claim 12 wherein said cradle pad includes opposite end portions and a center portion, and transition sections joining said end portions with said center portions, and wherein said transition sections are reduced in their transverse extent.

18. A railway tank car skid arrangement according to claim 17 wherein said transition section includes longitudinally extending spacers of reduced transverse extent.

* * * * *

UNITED STATES PATENT AND TRADEMARK OFFICE

CERTIFICATE OF CORRECTION

PATENT NO. : 4,220,097

DATED : September 2, 1980

INVENTOR(S) : Richard J. Wempe and Paul J. Dumser

It is certified that error appears in the above-identified patent and that said Letters Patent are hereby corrected as shown below:

Column 1, line 25, "by" first occurrence should read -- be --.

Column 2, line 36, "30" should read --36--.

Column 2, line 67, "bracekt" should read --bracket--.

Signed and Sealed this

Twentieth Day of January 1981

[SEAL]

Attest:

RENE D. TEGTMEYER

Attesting Officer

Acting Commissioner of Patents and Trademarks